US007752813B2

(12) United States Patent
Picchio

(10) Patent No.: US 7,752,813 B2
(45) Date of Patent: Jul. 13, 2010

(54) PARTITIONING SYSTEM

(75) Inventor: Cesare Picchio, Turate (IT)

(73) Assignee: Unifor S.p.A. (IT)

( * ) Notice: Subject to any disclaimer, the term of this patent is extended or adjusted under 35 U.S.C. 154(b) by 0 days.

(21) Appl. No.: 12/126,421

(22) Filed: May 23, 2008

(65) Prior Publication Data

US 2008/0282622 A1 Nov. 20, 2008

(30) Foreign Application Priority Data

May 25, 2007 (CA) ..... 2590106

(51) Int. Cl.
*E04F 19/00* (2006.01)

(52) U.S. Cl. ..... 52/36.4; 52/36.5; 52/239; 160/351

(58) Field of Classification Search ..... 52/36.4, 52/36.5, 238.1, 239, 481.1, 481.2; 108/50.1, 108/50.2, 152, 137, 143; 160/351; 211/184
See application file for complete search history.

(56) References Cited

U.S. PATENT DOCUMENTS 3,080,980 A * 3/1963 Gibbons ..... 248/222.52
4,269,005 A * 5/1981 Timmons ..... 52/36.6
4,817,538 A * 4/1989 Michaelsen ..... 108/108
4,833,848 A * 5/1989 Guerin ..... 52/242
4,986,330 A * 1/1991 McGonagle ..... 160/135
5,038,539 A * 8/1991 Kelley et al. ..... 52/239
5,212,918 A * 5/1993 Newhouse et al. ..... 52/126.3
5,241,796 A * 9/1993 Hellwig et al. ..... 52/36.4
5,309,686 A * 5/1994 Underwood et al. ..... 52/29
5,377,466 A * 1/1995 Insalaco et al. ..... 52/238.1
6,076,317 A * 6/2000 Hellwig et al. ..... 52/239
6,115,978 A * 9/2000 Bastian et al. ..... 52/243.1
6,161,347 A * 12/2000 Yu et al. ..... 52/220.7
6,167,664 B1 * 1/2001 Reuter et al. ..... 52/239
6,189,268 B1 * 2/2001 Carr et al. ..... 52/36.1
6,240,687 B1 * 6/2001 Chong ..... 52/238.1
6,272,795 B1 * 8/2001 Brauning ..... 52/36.1
6,349,516 B1 * 2/2002 Powell et al. ..... 52/239
6,378,255 B1 * 4/2002 Eich et al. ..... 52/220.7
6,393,782 B1 * 5/2002 Berridge et al. ..... 52/239
6,481,168 B1 * 11/2002 Hodges et al. ..... 52/220.7

(Continued)

FOREIGN PATENT DOCUMENTS

GB 2262029 A * 6/1993

*Primary Examiner*—Robert J Canfield
*Assistant Examiner*—Babajide Demuren
(74) *Attorney, Agent, or Firm*—Conley Rose, P.C.

(57) ABSTRACT

A partitioning system is disclosed and includes walls, stands and table tops. In use, each wall has: upper and lower ends; sides spaced apart from one another along a horizontal longitudinal axis; faces spaced apart from one another along a horizontal lateral axis normal to the longitudinal axis. Further, each wall, in use, defines: a longitudinal slot extending from one side to at least partially divide at least one of the faces; and a channel for said slot, said channel extending from the lower end of the wall, between the faces, to said slot to define a void in said wall. Each stand, in use, has: a ground-engaging base; an upright extending from the base within a channel; and a support arm extending transversely from the upright through the slot for which the channel is provided. Each table top is supported in use by one or more support arms.

6 Claims, 4 Drawing Sheets

U.S. PATENT DOCUMENTS 6,928,785 B2 * 8/2005 Shipman et al. ..... 52/745.1
2002/0095890 A1 * 7/2002 Brauning ..... 52/239
2002/0108330 A1 * 8/2002 Yu et al. ..... 52/238.1
2003/0196392 A1 * 10/2003 Edwards ..... 52/220.1
2004/0093805 A1 * 5/2004 Underwood et al. ..... 52/36.1
2005/0279033 A1 * 12/2005 Faber et al. ..... 52/36.4
2006/0059806 A1 * 3/2006 Gosling et al. ..... 52/238.1
2006/0207201 A1 * 9/2006 Klimek ..... 52/239
2006/0236625 A1 * 10/2006 MacDonald et al. ..... 52/239

* cited by examiner

PARTITIONING SYSTEM

CROSS-REFERENCE TO RELATED APPLICATIONS

This application claims priority under 37 C.F.R. §1.19 and 1.55 to Canadian Patent Application No. 2,590,106 filed May 25, 2007 and entitled "Partitioning System," hereby incorporated herein by reference.

STATEMENT REGARDING FEDERALLY SPONSORED RESEARCH OR DEVELOPMENT

Not Applicable.

FIELD OF THE INVENTION

The invention relates to the field of interior space partitioning.

BACKGROUND OF THE INVENTION

It is commonplace to partition interior spaces through the utilization of standard components which are adapted to interfit with one another to permit the construction of room partitions/dividers customized to meet the particular requirements of any given application. Sometimes, it is desirable to provide horizontal work surfaces, and it is known to do so by suspending table tops or the like from the partitions. This demands that the partitions be relatively robust, which has associated impacts on cost.

SUMMARY OF THE INVENTION

A partitioning system forms one aspect of the invention. The system comprises wall structures, stands and table top members. Each wall structure, in use, defines a slot and a channel and has an upper end and a lower end, a pair of sides spaced apart from one another along a horizontal longitudinal axis and a pair of faces spaced apart from one another along a horizontal lateral axis orientated substantially normally to the longitudinal axis. The slot extends longitudinally from one side of the wall structure to at least partially divide at least one of the faces. The channel is provided for said slot and extends from the lower end of the wall structure, between the faces, to said slot to define a longitudinal void in said wall member. Each stand, in use, has: a ground-engaging base; an upright extending from the base within a channel of a wall structure; and a support arm extending transversely from the upright through the slot for which the channel is provided. Each table top member is supported in use by one or more of the support arms.

In use, the partitioning system permits the relatively inexpensive construction of partitions, including those provided with work surfaces, both this use and the partitions so constructed also forming aspects of the invention.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter being briefly described hereinafter.

DETAILED DESCRIPTION

Figure 1:
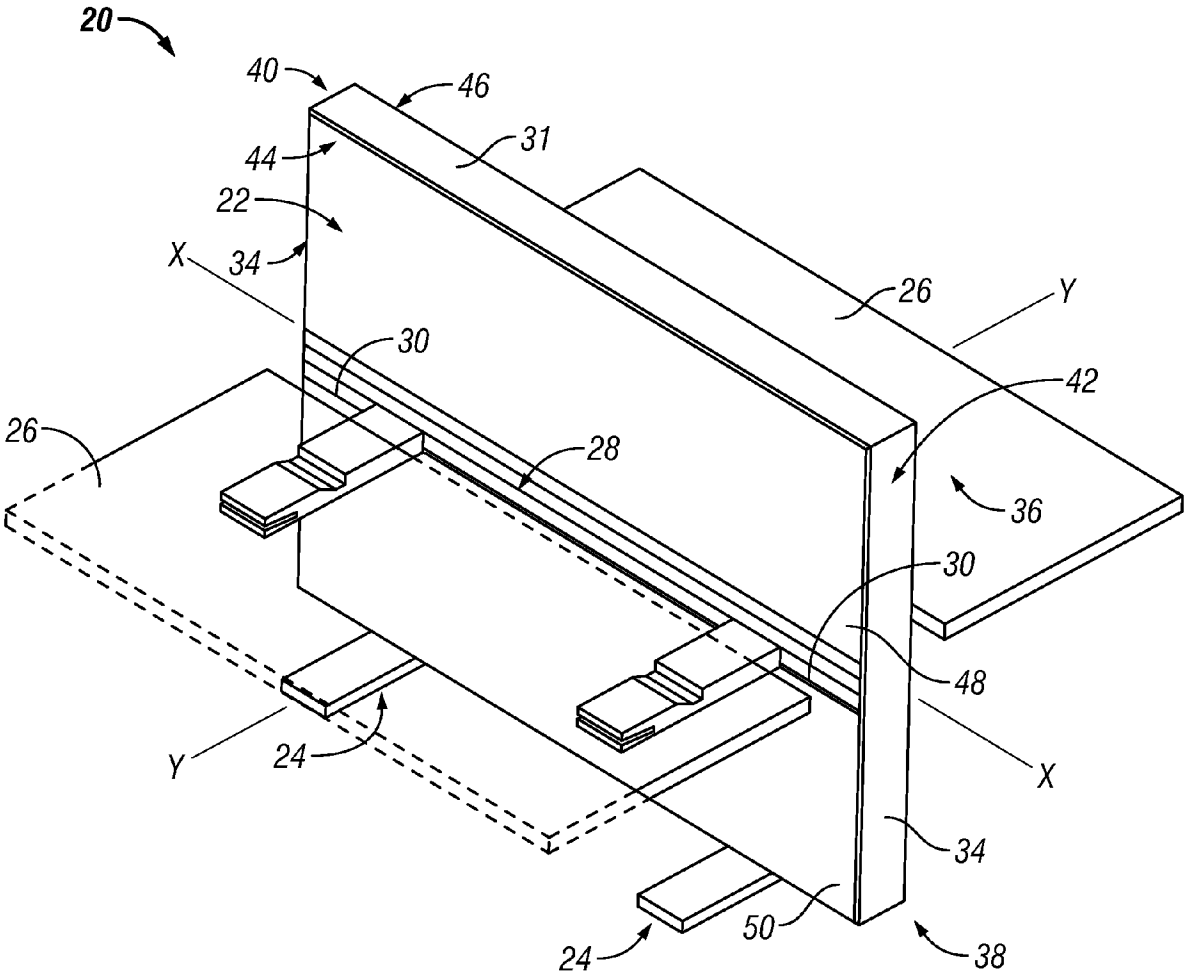
FIG. 1 is a perspective view of an exemplary workstation constructed with a system according to one embodiment of the invention, with portions shown in phantom, for clarity.

An exemplary work station constructed from components selected from a partitioning system according to a preferred embodiment of the invention is shown in FIG. 1 and designated with general reference numeral 20.

Figure 2:
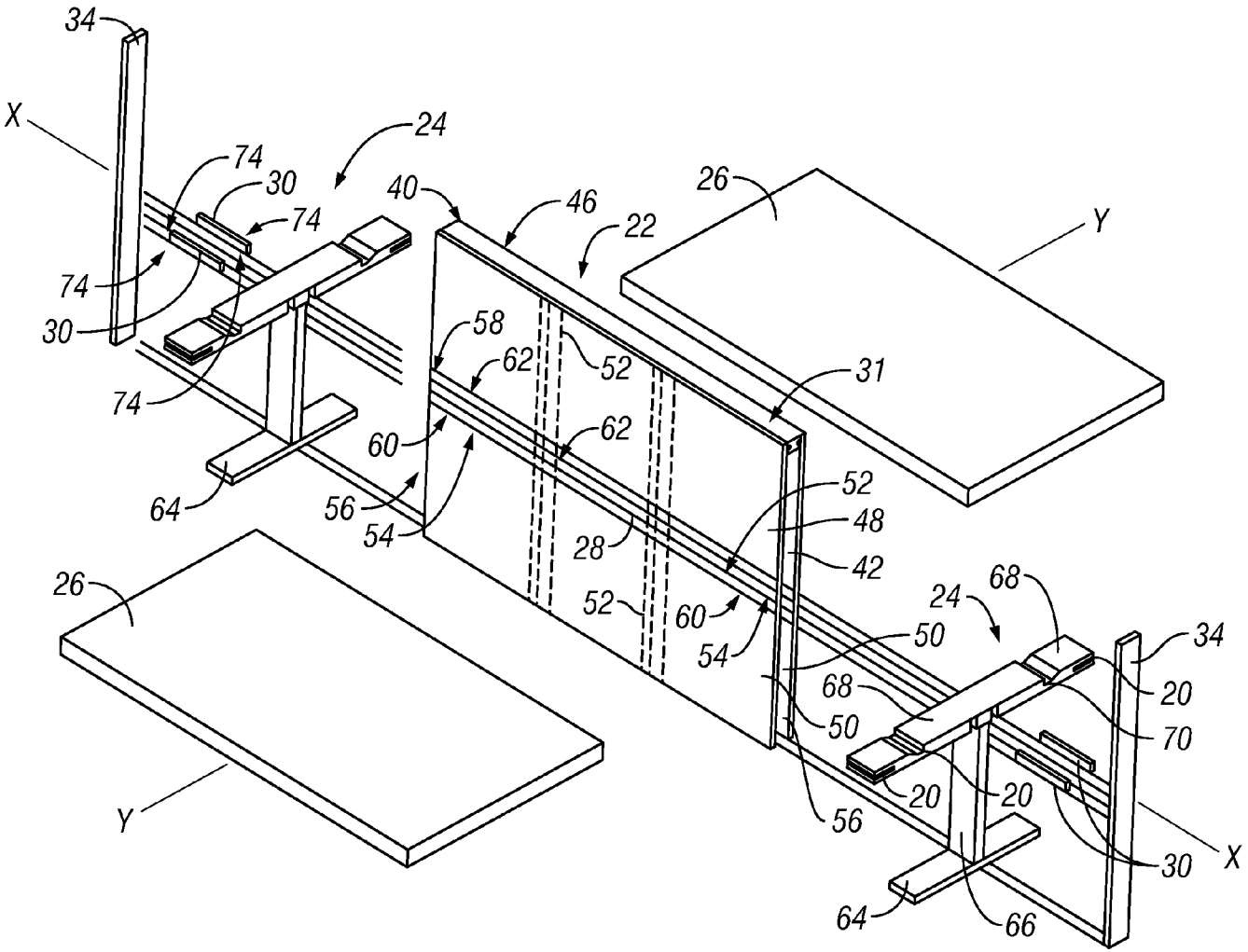
FIG. 2 is a partially exploded perspective view of the structure of FIG. 1.

As best seen in FIG. 2, the work station 20 comprises a wall structure 22, a pair of stands 24, a pair of table top members 26, track elements 30 and caps 34. (For greater clarity, one of the table top members 26 is illustrated in FIG. 1 in phantom outline.)

With reference to FIGS. 1 and 2, the wall structure 22 will be seen to have an upper end 36 and a lower end 38; a pair of sides 40,42 spaced apart from one another along a horizontal longitudinal axis X-X; and a pair of faces 44, 46 spaced apart from one another along a horizontal lateral axis Y-Y orientated substantially normally to the longitudinal axis X-X. The faces 44,46 are spaced apart from one another by at least one, specifically, two stud members 52, shown in phantom outline in FIG. 2.

Figure 4:
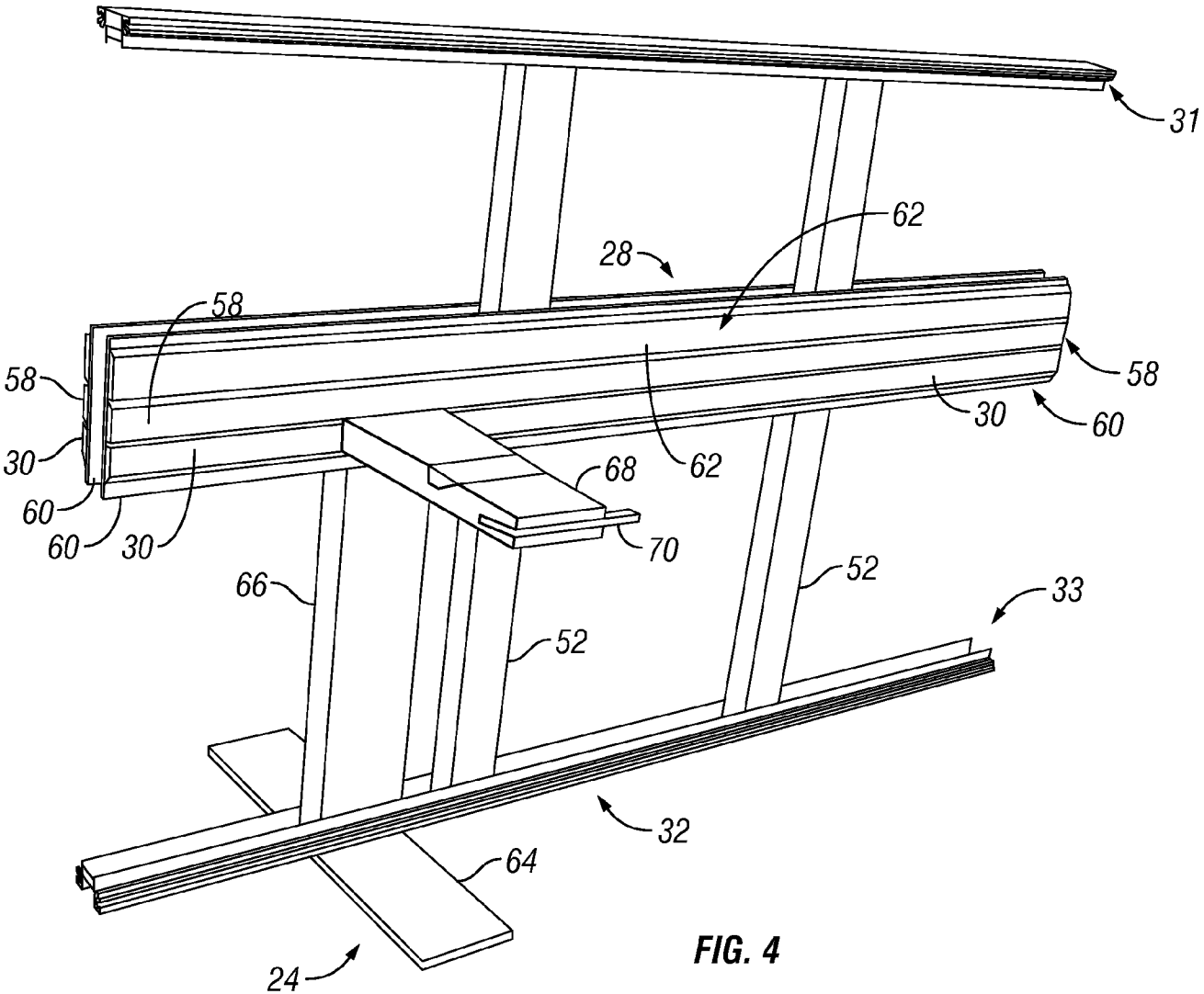
FIG. 4 is a perspective view of a frame element of the wall structure of FIG. 1 in use with one of the stands of FIG. 1.

The stud members 52 form part of a frame element 32 shown in FIG. 4 which includes a horizontally-extending bridge 28 and upper 31 and lower 33 horizontal rails secured by rivets to the stud members 52, all portions of frame element 32 being constructed out of aluminum.

Figure 3:
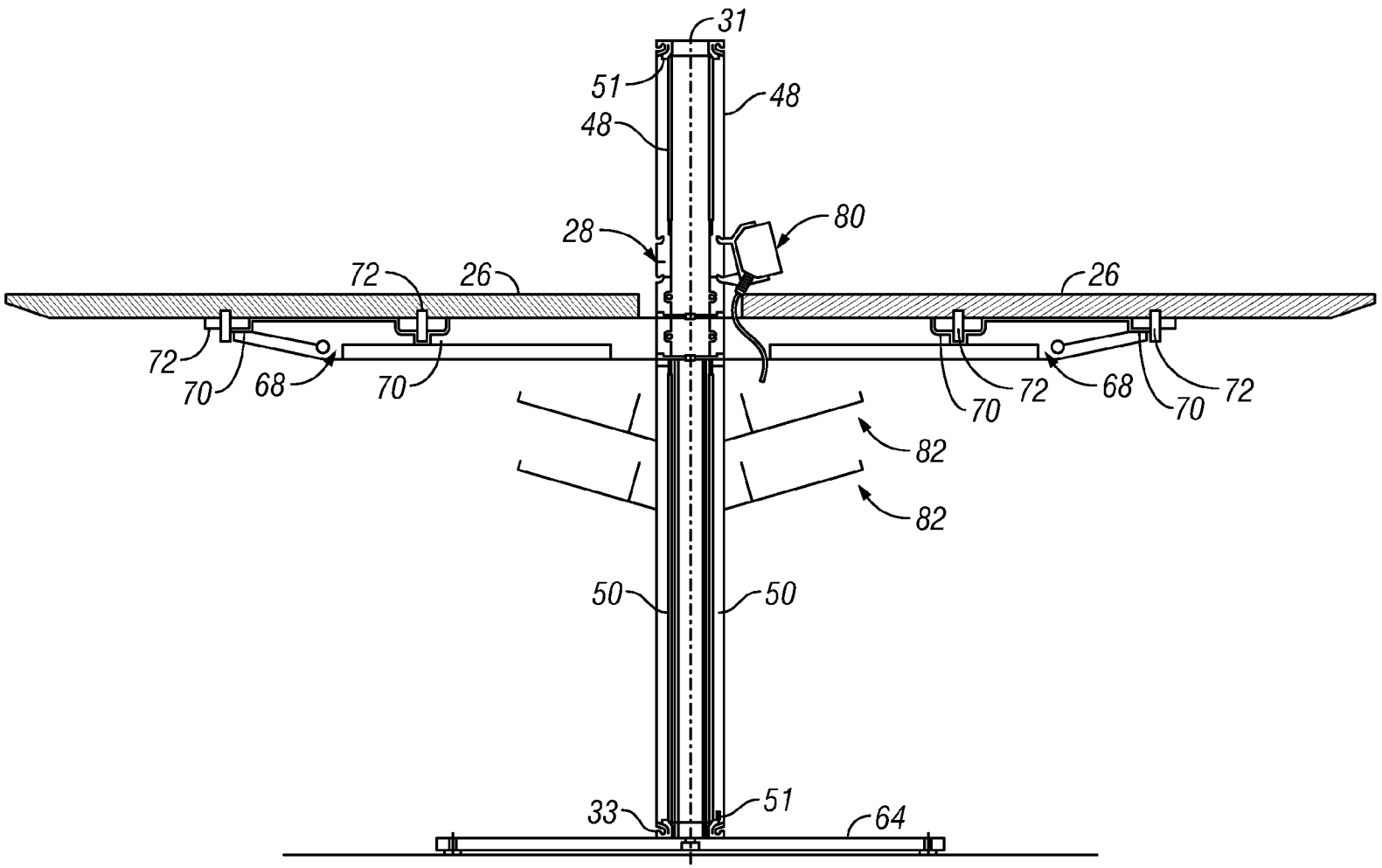
FIG. 3 is a cross-section of the structure of FIG. 1, with shelving and power receptacles installed.

With reference to FIGS. 2 and 3, each face 44,46 is partially defined by a respective pair of panels 48,50 spaced-apart from one another by the bridge 32. Panels 48,50 are constructed out of MDF or the like. Panels 48 terminate at their upper edges in elongate extruded aluminum hooks 51 which engage upper rail 31 and from which said panels 48 are suspended. Panels 50 also terminate at their lower edges in extruded aluminum hooks 51 which engage (split) lower rail 33 and have upper edges which engage the bridge 28 in snap-fit relation.

With reference to FIG. 2, the wall structure 22 defines a pair of slots 54, each slot 54 extending from a respective side 40,42 of the wall structure 22 to partially divide both of the faces 44,46 of the wall structure 22, and, for each slot 54, defines a channel 56, extending from the lower end 38 of the wall structure 22, between the faces 44,46, to said each slot 54. Each slot 54 and the channel 56 provided therefore collectively define a longitudinally-extending void in said wall structure 22 open to the side 40,42 of the wall structure from which said each slot 54 extends and having a tee profile when viewed longitudinally from said side 40,42. Each face 44,46 is provided, for each slot 54, with a track receiver comprising a pair of guides 58,60 vertically spaced apart from one another and forming part of bridge 28, each track receiver 58,60 extending lengthwise of the wall structure 22 to bound the slot 54 at its upper and lower periphery. Each face 44,46, specifically, the bridge 28, further defines a pair of longitudinally extending grooves 62 of arcuate cross section.

Each stand 24 has a base 64, an upright 66 extending from the base 64 and a pair of support arms 68 extending transversely from the upright 66 and away from one another. In use as shown in FIG. 1, the stands 24 are longitudinally spaced-apart from one another with each base 64 engaging the ground, the upright 66 thereof extending vertically from the base 64, inside a respective one of the channels 56, and the support arms 68 extending from the slots 54 to support the wall structure 22.

Each table top member 26 is supported in use by one or more of the support arms 68, and secured to the stands 24 by screws (not shown) which engage cooperating mounting brackets 72, 70 provided, respectively, on the underside of the table top member 26 and on the support arms 68.

The track elements 30 each have spaced-apart edges 74 each slidably engageable with a respective guide 58,60 so as to permit the track element 30 to be introduced between the guides 58,60 at one side 40,42 of the wall structure 22 and longitudinally slid therealong to occlude that part of the slots 54 not occupied by the support arms 68 and provide a neat appearance to the work station 20.

The cap members 34 are extruded elements adapted to snap-fit between the panels 48,50 to occlude the sides 40,42 of the wall structure 22 and provide a neat appearance to the work station 20.

Whereas the work station 20 of FIGS. 1 and 2 is a simple dual table structure, the pair of grooves 62 defined in the faces can be utilized to support an electrical receptacle 80, and shelving 82 can be secured to the panels, as shown in FIG. 3.

Whereas but two embodiments of the present invention are herein shown and described, it should be understood that numerous modifications are possible.

For example, whereas slots are provided on both faces of the wall structure shown, slots could be provided on only one face. As well, whereas slots are provided at both sides of the wall structure shown, a single slot could be provided. Further, whereas the slots shown partially divide the faces of the wall structure, a slot fully dividing one face of the wall structure could be provided. Additionally, the construction of the wall structure could depart from the frame element and panel construction shown.

As well, further modifications other than those indicated above are contemplated. Accordingly, the invention should be understood as limited only by the claims appended hereto, purposively construed.

The invention claimed is:

1. A partitioning system comprising:

wall structures, each wall structure, in use:

comprising: an upper end and a lower end; a pair of sides spaced apart from one another along a horizontal longitudinal axis; and a pair of faces spaced apart from one another along a horizontal lateral axis oriented substantially normally to the longitudinal axis, defining: a slot extending longitudinally from one side of the wall structure to at least partially divide both of the faces; and a channel provided for said slot, said channel extending from the lower end of the wall structure, between the faces, to said slot to define a longitudinal void in said wall structure having a tee profile when viewed longitudinally from the end of the wall structure;

stands, each stand, in use, comprising: a ground-engaging base; an upright extending from the base within a channel of a wall structure; and a pair of support arms extending transversely from the upright and away from one another and protruding, in use, through the slot for which the channel is provided, and where, in use, the support arms of each stand support the wall structure having the channel in which the upright of said each stand is positioned; and table top members, each table top member being supported in use or by one or more of the support arms.

2. A system according to claim 1, wherein the wall structure is defined a pair of slots each extending from a respective side of the wall structure to partially divide both of the faces of each wall structure.

3. A system according claim 1, wherein, in each face, a track receiver is provided for each of the slots at least partially dividing said each face; and further comprising a track element releasably engaged in use with each track-receiver is provided.

4. A system according to claim 3, wherein the track receiver comprises a pair of guides vertically spaced apart from one another in use and each extending lengthwise of the wall structure; and the track element has spaced-apart edges each slidably engageable with a respective guide so as to permit the track element to be introduced between the guides at one side of the wall structure and longitudinally slid into place.

5. A system according to claim 4, wherein each wall structure comprises:

a pair of panels for each face of the wall structure, the panels being vertically spaced-apart; and at least one stud member sandwiched by the panels.

6. A partition constructed with the system of claim 1.

* * * * *